US005713468A

United States Patent [19]

Streichan

[11] Patent Number: 5,713,468

[45] Date of Patent: Feb. 3, 1998

[54] SLIDABLE UTILITY BOX

[76] Inventor: Stephen J. Streichan, 1309 Orchard Ave., Napa, Calif. 94558

[21] Appl. No.: 663,365

[22] Filed: Jun. 13, 1996

[51] Int. Cl.[6] ..... B65D 85/28

[52] U.S. Cl. ..... 206/372; 206/373; 220/729; 220/731; 224/316; 190/8

[58] Field of Search ..... 206/349, 372, 206/373, 541, 542, 546; 190/8, 11; 220/729, 731, 733; 224/316; 280/8, 47.33, 47.26, 30, 37

[56] References Cited

U.S. PATENT DOCUMENTS

| | | | |
|---|---|---|---|
| 660,989 | 10/1900 | Flanders | 190/8 |
| 873,855 | 12/1907 | Goldin | 190/11 |
| 3,026,995 | 3/1962 | Slaughter | 206/541 |
| 3,618,556 | 11/1971 | Dittrich . | |
| 3,648,830 | 3/1972 | Graf | 206/541 |
| 4,550,828 | 11/1985 | Baldwin et al. . | |
| 4,640,392 | 2/1987 | Decker, Jr. et al. | 206/541 |
| 4,700,689 | 10/1987 | Speker | 220/731 |
| 4,733,703 | 3/1988 | Cimino . | |
| 4,840,273 | 6/1989 | Zavacki . | |
| 5,156,310 | 10/1992 | Biedenharn, Jr. . | |
| 5,325,966 | 7/1994 | Chang . | |
| 5,339,956 | 8/1994 | Thomason . | |
| 5,429,235 | 7/1995 | Chen | 206/373 |
| 5,429,265 | 7/1995 | Maire et al. | 206/372 |
| 5,439,108 | 8/1995 | Lackie | 206/373 |
| 5,503,571 | 4/1996 | Cheslock | 206/372 |
| 5,553,760 | 9/1996 | Wright et al. | 224/316 |

FOREIGN PATENT DOCUMENTS

| | | | |
|---|---|---|---|
| 2076761 | 12/1981 | United Kingdom | 224/316 |

*Primary Examiner*—David T. Fidei
*Attorney, Agent, or Firm*—Richard C. Litman

[57] ABSTRACT

A slidable utility box includes a number of features which are particularly well adapted for use in confined spaces (crawl spaces, attics, etc.). The box includes a pyramid shaped obstacle deflector, which may be removably secured to either end of the box. The bottom of the box is smoothly rounded into each of the opposite ends of the box, and is smooth and devoid of protrusions to preclude digging in to a soft or irregular surface. The lid is completely removable, and need only be lifted sufficiently high to clear the flange around the upper edge of the box upon which the lid seats, for removal of the lid. The lid may include hinged or removable legs, allowing the lid to be used as a seat if desired. The box may include trays or partitions for tools if desired, but these are preferably removable to provide added versatility for the box, e.g., for the removal of debris, material from an excavation, etc. The box is used by securing a line to the handle of the box at the forwardmost end, passing the line through the apex of the obstacle deflector, and securing the obstacle deflector to the forwardmost end of the box. The user may then enter the restricted space with the opposite end of the line and pull the box behind, with the obstacle deflector serving to guide the box over or around various obstacles (rubble, foundation footings, etc.) as they are encountered.

14 Claims, 5 Drawing Sheets

SLIDABLE UTILITY BOX

BACKGROUND OF THE INVENTION

1. Field of the Invention

The present invention relates generally to tool chests, boxes, containers, and the like, and more particularly to a slidable utility box which is adapted to be transported and used in confined areas, such as crawl spaces, attics, trenches, etc. The box includes a pyramidal deflector which may be secured to either end, and which enables the box to work over or around obstructions when pulled through the confined space, as well as other features which adapt the box particularly well for use in confined areas. The box may be used for the storage and containment of tools and equipment, or may be used as a means for transporting construction debris, excavated material, etc. from a confined space.

2. Description of the Prior Art

Persons working in the construction and contracting trades are often restricted to confined areas in the course of their work. Crawl spaces beneath homes and other structures, and attics in structures having low roofs, are typical of the working environment often encountered by plumbers, electricians, insulation installation crews, and heating, ventilation, and air conditioning contractors. The vertical space available is often so low, perhaps on the order of three feet or so, that all work and movement must be done in a crouched position.

Accordingly, it is often necessary to carry tools and equipment singly into such an area as they are needed, as in many cases a large toolbox or the like simply cannot fit in the work area. Obviously, such a technique is likely to result in many additional trips to retrieve yet another needed tool, and results in a good chance of inadvertently leaving a tool behind when the work is completed. While many toolboxes and tool chests may fit within such confined areas, they are generally adapted for lifting and carrying to and from various sites, which method cannot be used when the work space restricts the worker to a crouched, or even lower, position. Pushing or pulling such boxes over the often soft and/or rough terrain is generally an exercise in frustration, as the toolbox will generally catch one of its rectangular corners on some obstacle or another (foundation footings, rubble, soft earth, exposed joists, etc.) in a crawl space, attic, or other restricted area.

Moreover, conventional toolboxes and the like generally have hinged upper lids, which require the lid to be arcuately raised from the hinge line. In many cases, there is simply not sufficient room to access the contents of a relatively deep toolbox when the lid is raised in a confined area. Also, with the lid permanently secured to the box, the lid cannot be used for other purposes, and often cannot be raised to its maximum opening due to structure above the box, and returns to a closed position each time it is opened partially. The person using the box must then reopen the lid each time some article is removed from or placed in the box.

Accordingly, a need will be seen for a slidable utility box which is particularly adapted for use in confined areas. The box must include some form of deflection means, enabling the box to be pulled across an uneven surface and to deflect itself around and over obstacles thereon. The lid of the box should be completely removable, so that it may remain parallel to the box when being removed in order to reduce the required clearance for opening the box. As the lid is removable, it may be used as a supplementary seat, stool, parts tray, etc., depending upon the space available. While the interior of the box may contain partitions, bins, etc. for the separate storage of tools and supplies, preferably any such compartments are removable, so the box may be used for other purposes such as the removal of excavated material, rubble, etc. from a restricted site. A review of the prior art of which the inventor is aware, and the distinctions of the present invention from that prior art, is provided following.

U. S. Pat. No. 3,618,556 issued to Erich Dittrick on Nov. 9, 1971 describes Traffic Cones As Safety Devices In Road Traffic, comprising inflatable traffic cones having heavy bases for security. The upper portions of the cones may be deflated for storage. While the patent discloses a conical object, such traffic cones are not suited for use with the present invention, as the lightweight upper structure would not be capable of deflecting a heavier article to which it was attached, around an object. Moreover, no motivation or structure is provided by Dittrick to attach his traffic cone to extend horizontally from another structure.

U.S. Pat. No. 4,550,828 issued to Arthur Baldwin et al. on Nov. 5, 1985 describes a Portable Tool Box having a horizontal drawer disposed in the bottom portion thereof and a box-like lid substantially covering all sides of the box excepting the bottom. The lid must be lifted upwardly for the entire height of the box, including an upwardly extending fixed handle which projects through the box, for the lid to clear the box. No obstacle deflection means, nor means for towing or pulling the box across an uneven surface, is disclosed by Baldwin et al.

U.S. Pat. No. 4,733,703 issued to Eugene D. Cimino on Mar. 29, 1988 describes a Combination Tool Chest/Workbench comprising a large rollaround structure. The relatively great weight and small wheels, as well as the relatively tall construction, would render the Cimino chest unsuitable for use in the intended environment of the present invention. Excepting some drawers at one end and some interior storage space at the opposite end, most of the tools and articles which the Cimino bench is adapted to carry, are carried on exterior panels, rather than inside. No removable lid or obstacle deflection means is disclosed by Cimino for his workbench.

U.S. Pat. No. 4,840,273 issued to Robert G. Zavacki on Jun. 20, 1989 describes a Tool Retention Device comprising a channel riveted within the lid of a conventional benchtop toolbox. The channel is adapted to accept elongate articles therein, such as a hacksaw frame, etc., to save room in the lower portions of the box. Otherwise, the box is conventional and does not include obstacle deflection or other means adapted for use in a confined space.

U.S. Pat. No. 5,156,310 issued to Eric C. Biedenharn, Jr. on Oct. 20, 1992 describes a Combination Backpack And Stool, comprising a rectangular parallelepiped structure having a central seat supporting structure therein. The device is not adapted for use in the environment of the present invention, as the relatively small supporting pads or feet and the rectangular corners of the backpack would tend to catch and dig in to the underlying surface when the device is pulled across an uneven surface.

U.S. Pat. No. 5,325,966 issued to Fu-Ping Chang on Jul. 5, 1994 describes a Tool Box including cooperating mutual engagement means on each end of each side of each box portion. Each portion is a generally low, flat structure with a shallow cavity therein. Two of the portions may be locked together to form a shallow closed container, and multiple such portions may be interlocked together if desired. The device is not suited for use in the environment of the present invention, as no obstacle deflection means is disclosed, and the engagement means projecting from the lower surface would tend to catch on obstructions.

Finally, U.S. Pat. No. 5,339,956 issued to Raymon Thomason on Aug. 23, 1994 describes a Tool Box With Combined Elements, including a retractable electric cord, a measuring scale(s) formed in the lid, and various other features. No obstacle deflection means or other features adapted for use in confined spaces and/or irregular surfaces, are disclosed by Thomason.

None of the above inventions and patents, taken singly or in combination, is seen to describe the instant invention as claimed.

SUMMARY OF THE INVENTION

Accordingly, it is a principal object of the invention to provide an improved slidable utility box which is adapted for use in confined areas and further adapted to be slid across an irregular and/or soft surface with obstructions thereon.

It is another object of the invention to provide an improved slidable utility box which includes obstacle deflection means adapted to cause the box to be deflected over or around any obstacles encountered as it is slid across an irregular surface, which obstacle deflection means is removably installable on either end of the symmetrical box.

It is a further object of the invention to provide an improved slidable utility box which includes a lid which is removable horizontally without requirement for substantial lifting above the box.

An additional object of the invention is to provide an improved slidable utility box which lid may include removably attachable or foldable legs therewith, thereby allowing the lid to be used as a seat or workbench as desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 3:
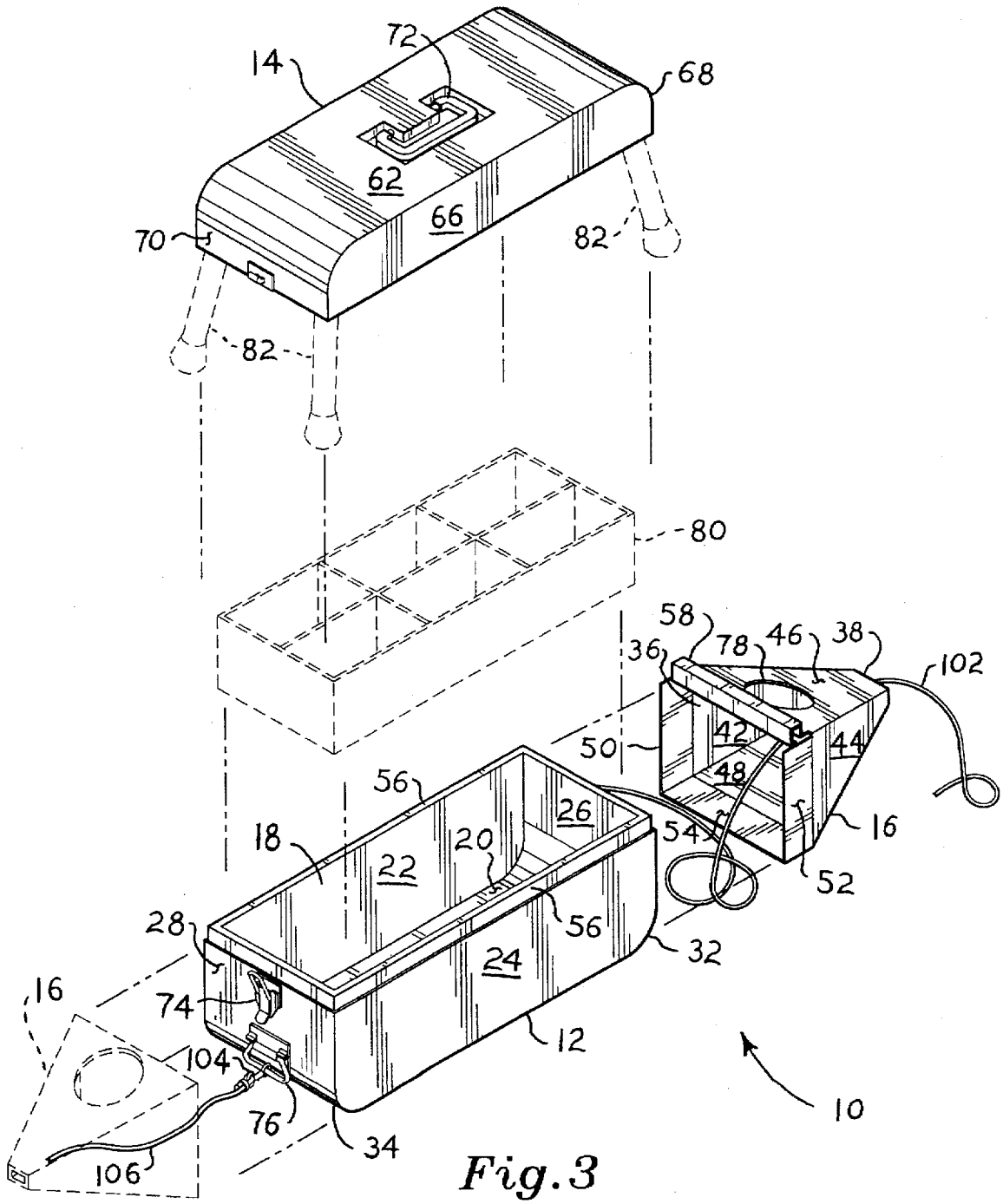
FIG. 3 is an exploded perspective view of the present slidable utility box, showing the removable installation of the obstacle deflector to either end of the box, and the lid removed from the box to show the interior and optional partitions.

The present invention comprises a slidable utility box, which is adapted to be pulled or otherwise moved across an irregular surface for use in a confined space. The present utility box is generally designated with the numeral 10 throughout the drawings. The major components comprising the utility box 10 are a container 12, a lid 14, and an obstacle deflector 16, and are shown in detail in FIG. 3 of the drawings.

Figure 1:
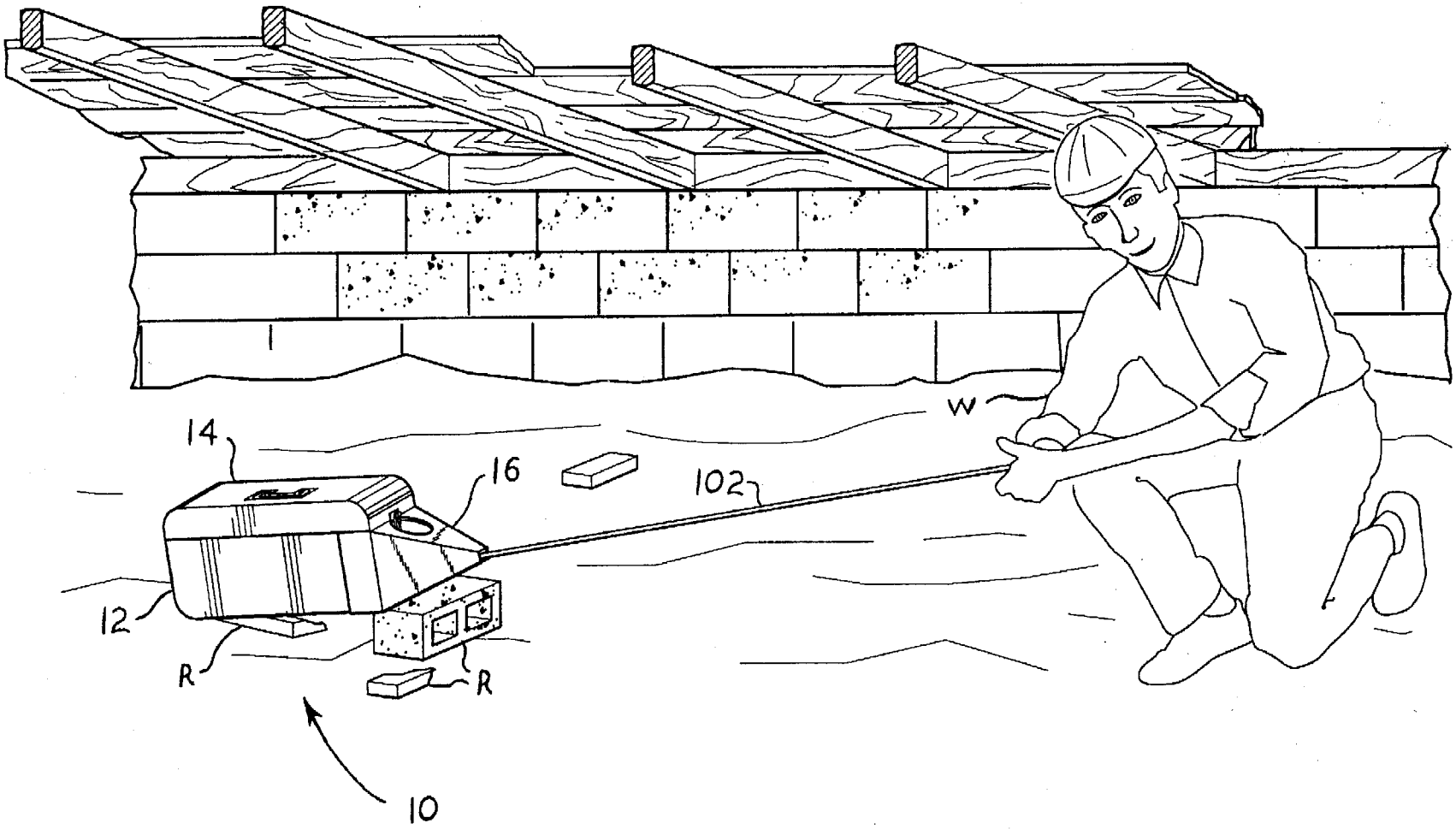
FIG. 1 is an environmental perspective view of the present slidable utility box, showing the means of sliding the box over an irregular surface for use in a confined space.

The container portion 12 of the utility box assembly 10 has a hollow, generally rectangular parallelepiped configuration, with an open top 18, a floor or bottom 20, opposite first and second sides 22 and 24, and opposite first and second ends 26 and 28. The bottom 20 of the container portion 12 will be seen in FIG. 4 to have a continuous, smooth, flat, planar exterior surface 30, which is unbroken by any protrusions, depressions, etc., and is well adapted to slide smoothly across or over any obstacles in an irregular surface, as shown in FIG. 1. Further assistance in providing for the movement of the present utility box 10 over such uneven surfaces, is provided by the smoothly rounded lower edges, respectively 32 and 34, where they blend into the bottom 20 of the container 12. As the present utility box 10 is particularly adapted for pulling or towing over an irregular surface from one or the other of its ends 26 or 28, the rounded lower edges 32 and 34 permit the container portion 12 to ride up and over any relatively small obstructions of any sort, and preclude the digging in of otherwise sharp edges into an underlying soft surface.

However, there are often situations where larger obstructions are encountered (construction rubble, foundation footings, etc.), and the rounded lower edges 32 and 34 of the first and second ends 26 and 28 are insufficient to provide smooth traverse of such obstructions. Accordingly, an obstacle deflector 16 may be removably secured to either end 26 or 28 of the longitudinally symmetrical container portion 12 of the present utility box 10, to provide further ease in drawing the box 10 across an irregular surface. The deflector 16 is in the form of a rigid hollow pyramid, having an open base 36, an apex 38 opposite the base 36 with the apex 38 having a draw line opening 40 therethrough (shown in FIG. 4), opposite first and second sides 42 and 44, and opposite top and bottom surfaces 46 and 48.

The forwardly tapered angles of each of the pyramidal faces 42 through 48 of the obstacle deflector 16, result in a glancing contact with any obstacles encountered by the deflector 16 and the container 12 secured thereto and following as the utility box 10 is pulled or otherwise moved across an irregular surface. Thus, the utility box 10 will tend to be levered up or around any obstacles which may be encountered due to the angular, ramp like effect of the tapered faces 42 through 48 of the deflector 16, as shown in FIG. 1, rather than presenting a blunt, oblique forward end (i.e., the first or second end 26 or 28, depending upon the orientation of the box 10) which is much more likely to catch on one or more obstacles.

The sides 42 and 44 and the bottom surface 48 of the obstacle deflection means 16 each have a flange extending therefrom, respectively 50, 52, and 54, which flanges 50 through 54 are smooth, flat, planar sheets having a cross section forming three sides of a rectangle. The open base 36 of the obstacle deflector 16, with the three flanges 50 through 54 extending therefrom, is sized so as to fit precisely over either of the two identical ends 26 and 28 of the container portion 12, with the flanges 50 through 54 respectively positioned closely against a portion of the first and second sides 22 and 24, and the bottom 20 exterior surface 30, of the container 12 when the deflector 10 is removably installed on one of the container 12 ends 26 or 28. These flanges 50 through 54 extend rearwardly when the utility box 10 is pulled in the direction of the deflector 16, and serve to preclude any obstacles from catching between the deflector 16 and the forwardmost end 26 or 28 (depending upon direction of travel) of the utility box 10.

The means for removably retaining the obstacle deflector 16 to the one of the ends 26 or 28 of the container 12, is provided by mutually engaging flanges along their respective upper edges. The container 12 includes an inwardly and upwardly extending flange 56 formed around the periphery of the open top 18 of the container 12, while the upper surface 46 of the obstacle deflector 16 has a similarly shaped, but slightly larger, flange 58 extending therefrom. The deflector flange 58 is configured to fit over the flange 56 of the container 12 at one of the two ends 26 or 28 thereof, to secure the deflector 16 removably to the container 12.

The obstacle deflector retaining flange 58 is removably secured over the container flange 56 at one of the container ends 26 or 28, by removing the lid 14 from the container 12. The deflector retaining flange 58 is secured to the container flange 56 by tilting the obstacle deflector upwardly to engage the edge of the deflector flange 58 beneath the container flange 56. The obstacle deflector 16 is then tilted forward, with the axis of the pyramid shape generally parallel to the longitudinal axis of the container 12 and with the side and bottom flanges 50 through 54 of the deflector extending partially back along the respective sides 22 and 24 and the bottom 20 of the container 12.

It will be noted that the lid 14 is congruent with the container 12 when secured thereto, and includes a downwardly and inwardly directed flange 60, which is configured to fit closely about the container flange 56 when the lid 14 is secured to the container 12. The deflector securing flange 58 is sufficiently thin so as to fit easily between the container flange 56 and the lid flange 60 when the lid 14 is secured to the container 12, thus further locking the obstacle deflector 16 in place on one of the ends 26 or 28 of the container 12 to complete the utility box 10 assembly. While the present utility box 10 and its components 12, 14, and 16 may be made of various materials (plastics, etc.), sheet metal construction provides a sturdy, durable structure. If sheet metal is used, some additional seams (not shown, for clarity in the drawings) may be provided along each of the relatively thin, sharp edges of the flanges 56 through 60, to eliminate such sharp edges.

Just as the bottom surface 30 and the obstacle deflector 16 are adapted to provide a smooth, unbroken surface to provide the least possible resistance as the utility box 10 is slid over an irregular surface, so the sides of both the container 12 and the lid 14 are similarly configured. The lid 14 includes an upper surface 62, a first side 64 (FIG. 4) and an opposite second side 66, and a first end 68 (FIG. 4) and an opposite second end 70, which ends 68 and 70 may be smoothly rounded in the manner of the rounded lower edges 32 and 24 of the container ends 26 and 28.

The sides 64 and 66 of the lid 14, and the sides 22 and 24 of the container 12, are all smooth, flat, planar sheets, devoid of any protrusions, depressions, handles, latches, etc. which would deviate from such smooth surfaces, with the lid 14 sides 68 and 70 being essentially coplanar with the corresponding container sides 22 and 24 when the lid 14 is secured to the container 12. This provides further protection against the utility box 10 snagging or being caught on some obstacle while being moved, as all latches, handles, etc. are either disposed to the ends of the box 10, or in the case of the lid handle 72, preferably recessed within the upper surface 62 of the lid 14. As no handle or latch means are provided along each of the sides 22 and 24 of the container 12 and sides 64 and 66 of the lid 14, identical latches 74 are provided at each of the container ends 26 and 28 to secure the lid 14 thereto. Also, identical handles 76 are secured to each of the container ends 26 and 28, to enable a person to move or otherwise handle the container portion 12 when the lid 14 is removed therefrom.

It will be seen that the latch 74 and handle 76 disposed at the end 26 or 28 to which the obstacle deflector 16 is secured, cannot be accessed if all of the surfaces 42 through 48 of the deflector 16 are solid, unbroken sheets. Accordingly, a latch and handle access hole 78 is provided through the top panel 46 of the obstacle deflector 16, to enable a user of the present utility box 10 to access the latch 74 therein to release or secure the lid 14 to the container 12, and/or to access the handle 76 at that end of the container 12.

Further utility for the present utility box 10 may be provided by means of a tray 80, or other insert which may be placed within the container 12 to hold smaller tools, parts, etc. Preferably, such a tray 80 is removable, in order to increase the versatility of the utility box 10, and to provide for use of the container 12 as a general purpose receptacle, e.g. for the removal of excavated material, construction rubble, etc., as desired.

Figure 2:
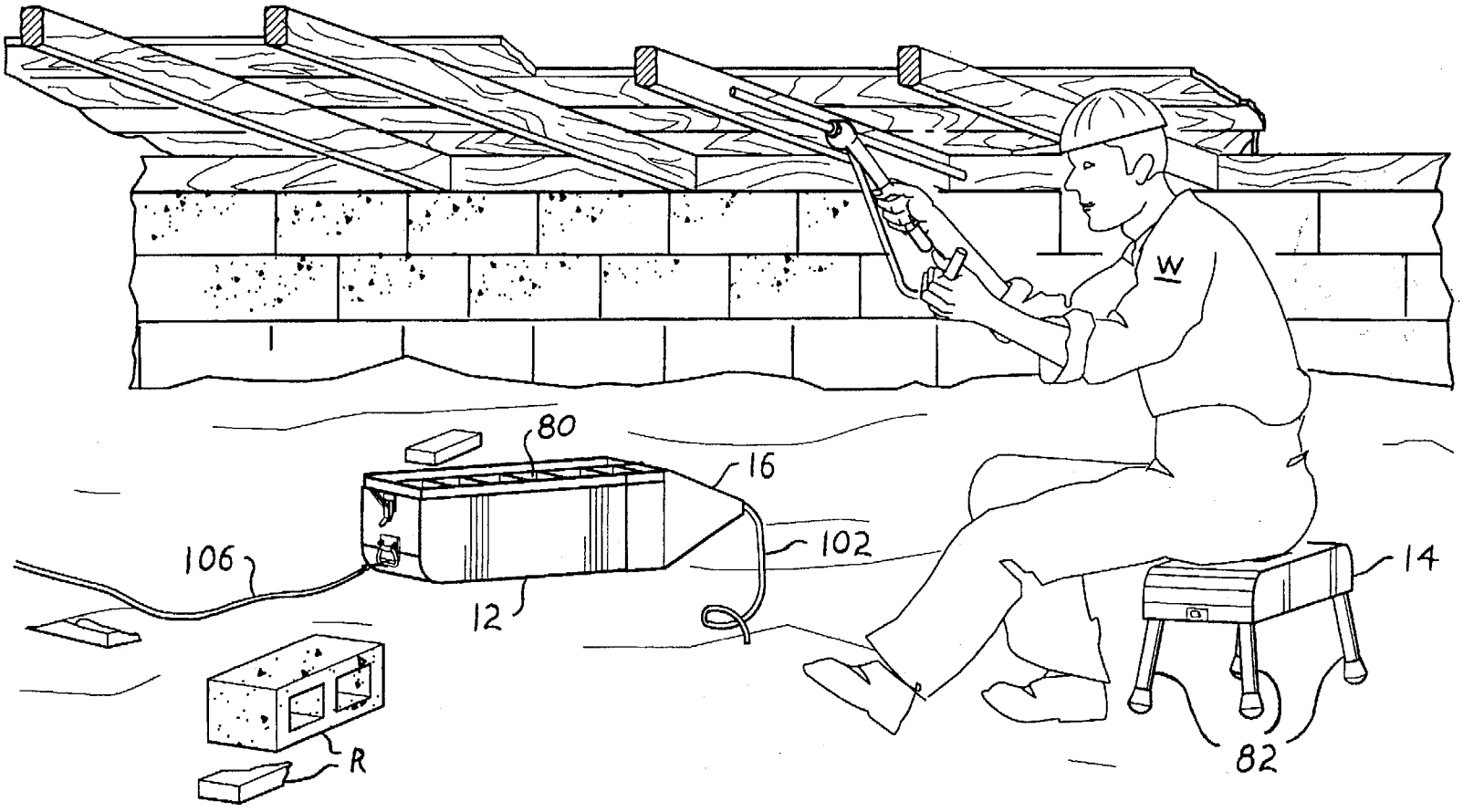
FIG. 2 is an environmental perspective view of the present slidable utility box with the lid removed and being used as a seat for a worker using the present box.

Another very useful feature of the present utility box 10, provided by the removable lid 14, is that the lid 14 may be used for other purposes once it has been removed from the container portion 12 of the box assembly 10. In many cases, the working environment may not permit a worker to stand, but sufficient vertical space will exist for a worker to work from a seated position. Accordingly, a set of legs, e. g., legs 82, may be provided for the lid 14, to enable the lid 14 to be used as seating means, as shown in FIG. 2 of the drawings and as shown in detail in FIGS. 5A, 5B, and 5C of the drawings.

Figure 5A:
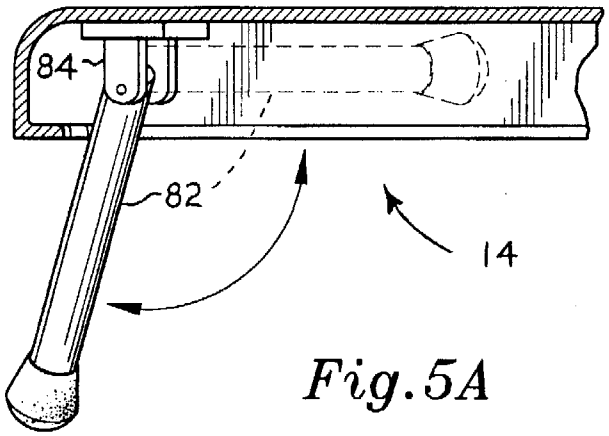
FIG. 5A is a broken away elevation view in section of a first lid embodiment, showing the inclusion of folding legs therewith.

FIG. 5A discloses one means of providing such legs enabling the lid 14 to be used as seating means, wherein a hinged leg 82 is foldably secured beneath each corner of the lid 14. Preferably, sufficient friction is provided in the hinge means 84 to hold the legs 82 in an upwardly folded position when the lid 14 is not being used as a seat.

Figure 5B:
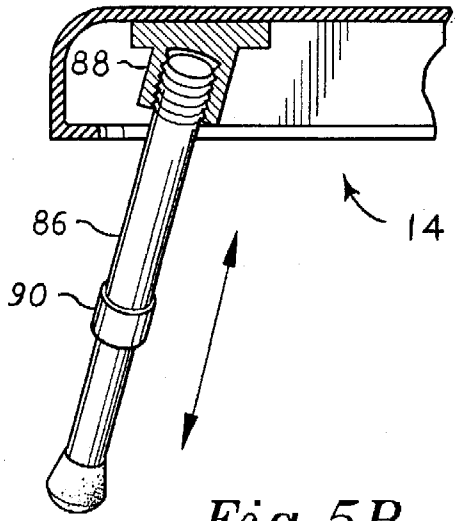
FIG. 5B is a broken away elevation view in section of a second lid embodiment, showing the threaded attachment of telescopingly adjustable legs therewith.

Alternatively, telescopingly adjustable legs 86 may be provided, which are threadedly secured within a socket 88 secured within the underside of the lid 14, as shown in FIG. 5B. Locking means may be provided for the telescoping length of the legs 86 by means of a locking collar 90, similar to the means often used to secure the adjustable height of telescoping microphone stands, tripod legs, etc.

Figure 5C:
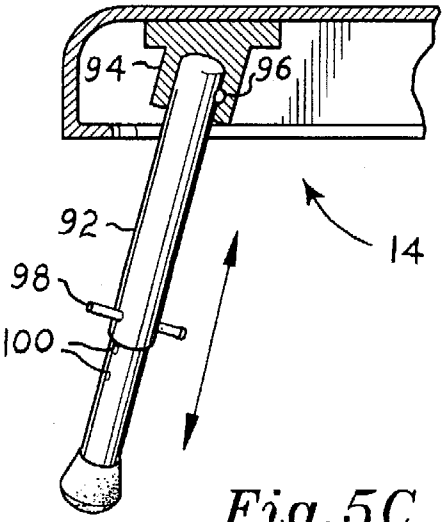
FIG. 5C is a broken away elevation view in section of a third lid embodiment, showing the removable attachment of telescopingly adjustable legs therewith.

Another telescoping leg arrangement and removable attachment means is shown in FIG. 5C, where telescopingly adjustable legs 92 are removably retained in a socket 94 by means of a spring loaded retaining ball 96, in the manner of the retaining means used to secure a socket removably to a square drive ratchet. Locking means for the length adjustment of the legs 92 may be provided by a lateral pin 98, installed through one of a series of holes 100 through the legs 92. It will be seen that different combinations of the above described leg configurations may be used with one another as desired, e.g., one of the telescoping means shown in FIGS. 5B and 5C may be incorporated with the hinged legs 82 of FIG. 5A, and/or the telescoping means shown in FIGS. 5B and 5C may be interchanged, etc.

Figure 4:
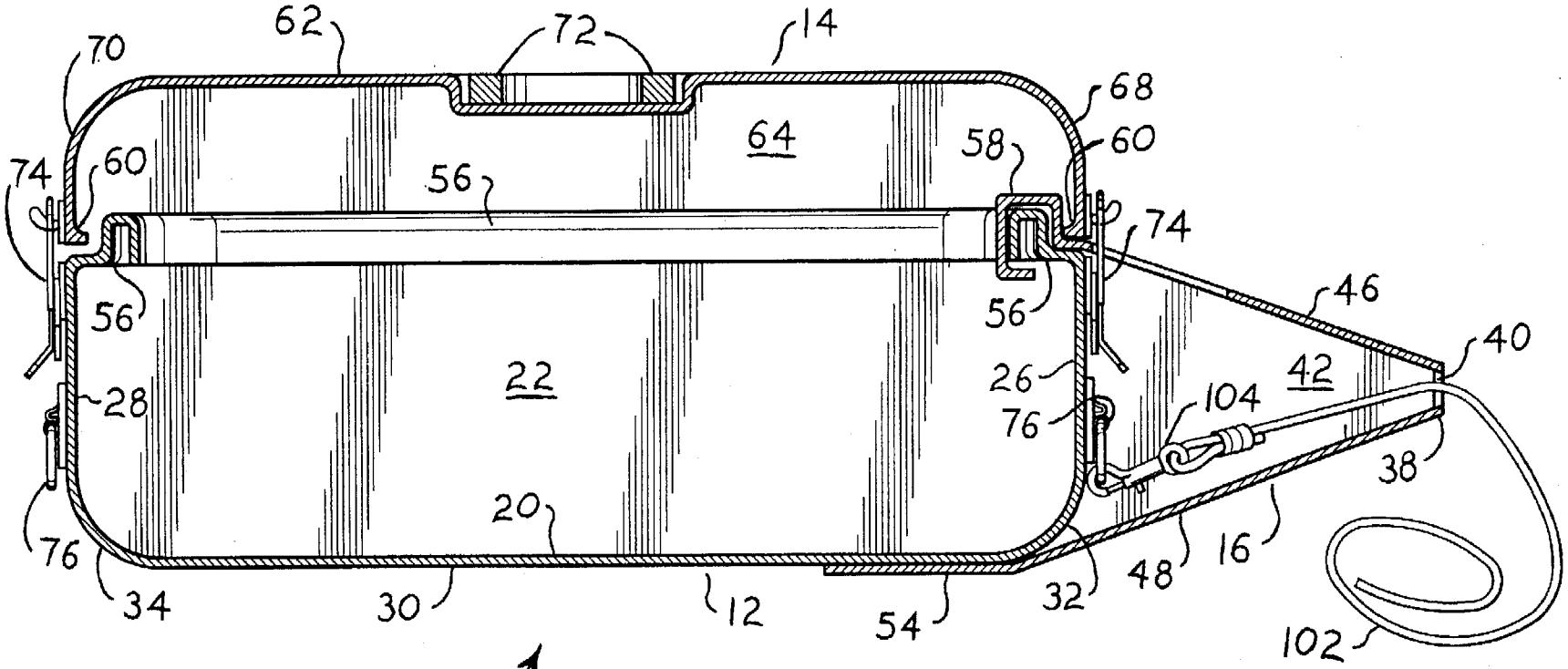
FIG. 4 is a side elevation view in section of the present slidable utility box, showing various details of the interfitting flanges of the lid and obstacle deflector, and the latch means and handle means.

The present slidable utility box 10 is well adapted for use in areas of restricted vertical clearance, and/or other confined areas (trench work, etc.). Rather than lifting the box 10 by the lid handle 72 and/or container end handles 76, the user may pass a draw line 102 (rope, etc.) through the draw line opening 40 in the apex 38 of the obstacle deflector 16, and secure it to the appropriate container handle 76, i.e., the handle secured to the first end 26, as shown in FIG. 4. The line 102 may be tied to the handle, or secured thereto using a clip 104, or otherwise secured.

At this point, a worker W using the present utility box 10 need only place the box 10 in position to be dragged to the work area, and enter the work area with the free end of the draw line 102. (The free end of the draw line 102 may be clipped or otherwise secured to the worker's belt, etc., to free the worker's hands for use in maneuvering in the limited work space available.) The utility box 10 may be drawn behind the worker as he moves into the work area, or may be drawn into the work area once the worker W is positioned, as shown in FIG. 1.

As the slidable utility box 10 is slidingly drawn into position, occasional obstacles, such as the construction rubble R shown in FIG. 1, or foundation footings, etc. may be encountered. The obstacle deflection means 16 removably secured to the first end 26 of the utility box assembly 10, enables the box 10 to be deflected upwardly or to the side of such obstacles, enabling the worker W to continue to draw the box 10 into position without need to leave his position to free the box 10 from a snag or impediment.

Once the utility box 10 has been drawn to the work location, the worker W may remove the lid 14 from the container portion 12 to access tools, parts, etc. as desired. (The tray 80 shown in figure 2 may be provided, but is preferably removable to increase the versatility of the container 12.) The lid 14 may include hinged legs 82 which may be extended from the lid 14, as shown in FIGS. 2 and 5A, or other leg means, such as the detachable legs 86 and 92 of FIGS. 5B and 5C, respectively. Assuming sufficient vertical space exists, the worker may extend or attach the legs 82/86/92, as applicable, to the lid 14 and use the lid 14 with its extended legs as a seat, as shown in FIG. 2. Alternatively, and particularly where even less vertical room is provided, the lid 14 may be inverted for use as a supplemental parts or tool tray, if desired.

When the work has been completed, the utility box assembly 10 may be removed in the same manner as used for its initial positioning, by means of a retrieve line 106, drawn into the work area at the time the box 10 was drawn into position. The draw line 104 is detached from the first end 26 handle 76, and may be stowed within the container 12 or otherwise retrieved. The retrieve line 106 is temporarily detached from the second end 28 handle 76, and the obstacle deflector 16 removed from the first end 26, secured to the second end 28, the legs 82/86/92 stowed, and the lid 14 secured to the container 12 to reverse the orientation of the utility box assembly 10. Another worker may then use the retrieve line 106 to draw the utility box 10 from the work site, or the worker W may do so once he clears the confined work area.

Alternatively, it will be seen that a single worker may use the present utility box to great advantage, drawing the box into the work area as described above and as shown in FIG. 1. When work has ended, the box 10 may be turned around without need to remove the obstacle deflector 16 from the first end 26 and to install it on the second end 28. The worker W need only leave the work area with the free end of the draw line 102, and draw the utility box 10 after him.

In summary, the present slidable utility box will be seen to be a most useful accessory for workers and others who have occasion to work or visit areas where space, and particularly vertical space, is limited. While the present utility box is particularly well adapted for use as a tool box, it will be seen that many other uses are possible, such as the removal of excavation debris, construction rubble, etc. Other persons who may have need to visit such areas, such as technical photographers, building inspectors, exterminators, etc. will all find the present utility box to be a most handy accessory for the carriage of equipment. The removable lid of the present box requires only a fraction of an inch of vertical clearance for removal from the container portion, in order to clear the upwardly extending flange about the periphery of the container portion. Thus, the present slidable utility box will be of use in virtually any location accessible by a worker.

It is to be understood that the present invention is not limited to the sole embodiment described above, but encompasses any and all embodiments within the scope of the following claims.

I claim:

1. A slidable utility box, comprising:

a container having an open top, opposite first and second ends, and a bottom having an exterior surface adapted to slide smoothly over an irregular surface;

a lid congruent with and removably securable to said open top of said container; and an obstacle deflector removably securable to one of said first and second ends of said container, said obstacle deflector including a hollow pyramidal structure having an open base and an apex with an opening therein.

2. The slidable utility box according to claim 1, wherein:

said container and said lid have a rectangular parallelipiped configuration and are each longitudinally symmetrical, each said opposite first and second ends of said container having a smoothly rounded lower edge which blends smoothly with said bottom of said container, said bottom of said container having a continuous, smooth, planar surface; and said container and said lid each include opposite first and second sides, said sides each forming a continuous, smooth, planar surface.

3. The slidable utility box according to claim 1, wherein:

said obstacle deflector includes opposite first and second sides, a top surface, and an opposite bottom surface;

said first and second sides and said bottom surface of said obstacle deflector each including a flange extending therefrom, said flange comprising a smooth, flat, planar sheet.

4. The slidable utility box according to claim 3, including:

retaining means for securing said obstacle deflector to said container, said retaining means comprising an inwardly and upwardly extending flange formed peripherally about said open top of said container; and a mating congruently shaped flange extending from said top surface of said obstacle deflector, said flange of said obstacle deflector being removably securable over said flange of said container.

5. A slidable utility box comprising:

a container having an open top, opposite first and second ends, and a bottom having an exterior surface adapted to slide smoothly over an irregular surface;

a lid congruent with and removably securable to said open top of said container, said lid having opposite first and second ends;

an obstacle deflector removably securable to one of said first and second ends of said container;

each said opposite first and second ends of said container and said lid having mating latch means for removably securing of said lid to said container;

said container further includes a handle means secured to each of said ends thereof;

said container further including an inwardly and upwardly extending flange formed peripherally about said open top;

said lid including a downwardly and inwardly extending flange therearound, said lid flange fitting closely about said container flange when said lid is secured to said container by said latch means; and said obstacle deflector including an access hole for providing access to said latch means and said handle.

6. The slidable utility box according to claim 1, further comprising at least one tray removably installable in said container.

7. A slidable utility box comprising:

a container having an open top, opposite first and second ends, and a bottom having an exterior surface adapted to slide smoothly over an irregular surface;

a lid congruent with and removably securable to said open top of said container, said lid includes a plurality of legs extendible therefrom, thereby adapting said lid as seating means when said lid is removed from said container and said legs are extended from said lid; and a pyramidal obstacle deflector removably securable to one of said first and second ends of said container.

8. The slidable utility box according to claim 7, wherein:

said legs are hingedly secured to said lid and are disposed beneath and within said lid when said legs are folded.

9. The slidable utility box according to claim 7, wherein:

said legs are removably securable to said lid.

10. The slidable utility box according to claim 7, wherein:

said legs are telescopingly extendible and retractable.

11. The slidable utility box according to claim 5, wherein said container and said lid have a rectangular parallelipiped configuration and are each longitudinally symmetrical, said opposite first and second ends of said container each having a smoothly rounded lower edge which blends smoothly with said bottom of said container, said bottom of said container having a continuous, smooth, planar surface.

12. The slidable utility box according to claim 5, wherein said container and said lid each include opposite first and second sides, said sides each forming a continuous, smooth, planar surface.

13. The slidable utility box according to claim 5 wherein:

said obstacle deflector includes a hollow pyramidal structure having an open base, an apex having an opening therein, opposite first and second sides, a top surface, and an opposite bottom surface;

said first and second sides and said bottom surface of said obstacle deflector each including a flange extending therefrom, said flange comprising a smooth, flat, planar sheet.

14. The slidable utility box according to claim 5, including:

retaining means for securing said obstacle deflector to said container, said retaining means comprising an inwardly and upwardly extending flange formed peripherally about said open top of said container; and a mating congruently shaped flange extending from said top surface of said obstacle deflector, said flange of said obstacle deflector being removably securable over said flange of said container.

* * * * *